US006056620A

United States Patent [19]

Tobin

[11] Patent Number: 6,056,620

[45] Date of Patent: May 2, 2000

[54] CONSTRUCTION SET FOR MARBLE TRACK WITH MID-AIR TRAJECTORIES FROM A VERTICAL PLANAR SURFACE

[75] Inventor: Adam Zev Tobin, San Anselmo, Calif.

[73] Assignee: Think of it, Inc., Ventura, Calif.

[21] Appl. No.: 09/081,543

[22] Filed: May 19, 1998

Related U.S. Application Data

[60] Provisional application No. 60/047,231, May 20, 1997.

[51] Int. Cl.[7] ..... A63H 33/00

[52] U.S. Cl. ..... 446/168; 446/92; 273/120 R

[58] Field of Search ..... 446/89, 92, 168, 446/169, 170, 171, 172, 173, 174, 227; 273/108, 118 R, 120 R, 121 D, 121 E, 122 R, 118 D, 120 A

[56] References Cited

U.S. PATENT DOCUMENTS

| | | | |
|---|---|---|---|
| 1,252,616 | 1/1918 | Reif . | |
| 1,279,270 | 9/1918 | Cole | 446/168 |
| 1,450,375 | 4/1923 | Kehl . | |
| 1,696,532 | 12/1928 | Enloe | 446/173 |
| 1,826,215 | 10/1931 | Hutchinson | 273/120 R |
| 2,205,936 | 6/1940 | Sullivan | 446/168 |
| 2,729,914 | 1/1956 | Cook | 446/168 |
| 2,998,673 | 9/1961 | Rhodes | 446/168 |
| 3,314,169 | 4/1967 | Wold | 273/120 R |
| 3,438,633 | 4/1969 | Thomas | 273/120 |
| 3,689,074 | 9/1972 | Benton et al. | 273/153 R |
| 3,696,549 | 10/1972 | Zilius . | |
| 3,800,443 | 4/1974 | O'Connell et al. | 35/35 H |
| 3,801,094 | 4/1974 | Treaster | 272/8 R |
| 3,818,628 | 6/1974 | Ensmann et al. | 446/173 |
| 4,037,355 | 7/1977 | Street . | |
| 4,171,090 | 10/1979 | Eisenburg | 238/10 |
| 5,007,876 | 4/1991 | Klitsner | 446/168 |
| 5,056,789 | 10/1991 | Talbot | 273/153 R |
| 5,314,367 | 5/1994 | Schaefer | 446/168 |
| 5,385,472 | 1/1995 | Mullin | 446/89 |
| 5,451,177 | 9/1995 | Gilman | 446/128 |

FOREIGN PATENT DOCUMENTS

| | | | |
|---|---|---|---|
| 489242 | 1/1930 | Germany | 446/168 |
| 47513 | 2/1919 | Sweden . | |

OTHER PUBLICATIONS

Motion Factory packaging, Tobin Toys, San Rafael, CA, 1995 (1 sheet).

Tube Trax packaging, Battat Inc., Plattsburgh, New York, 1993 (2 sheets).

Blocks and Marbles packaging, Blocks and Marbles Brand Toys, Inc., Crawfordsville, Indiana, 1987 (1 sheet).

*Primary Examiner*—Robert A. Hafer
*Assistant Examiner*—Jeffrey D. Carlson
*Attorney, Agent, or Firm*—Laurence J. Shaw

[57] ABSTRACT

A marble track construction toy for assembly on a vertically-oriented planar surface. The construction toy includes chutes down which the marble can roll, pivot elements and bumpers for altering the direction of the motion of the marble, and a catch basket for retaining the marble at the terminus of the track. Each chute includes a mounting means so the chute can be mounted on the vertically-oriented planar surface with both ends of the chute oriented parallel to the planar surface. Similarly, each bumper includes a mounting means so the bumper can be mounted on the vertically-oriented planar surface with an impact surface oriented perpendicular to the mounting surface. And each pivot element has a bucket and a pivoting bucket arm, and includes a mounting means so the pivot element can be mounted on the vertically-oriented planar surface such that the bucket pivots in the plane of the mounting surface. An operable marble track is constructed by adjustments of the positions of the chutes, pivot elements and bumpers, and adjustments of the orientations of the chutes, to insure that the catch buckets, chutes and catch basket are positioned to receive the marble at the terminus of its sequence of mid-air trajectories. In one preferred embodiment magnets are used as the surface-mounting means, so the track can be constructed on para-magnetic or ferromagnetic surfaces such as refrigerator doors.

7 Claims, 1 Drawing Sheet

CONSTRUCTION SET FOR MARBLE TRACK WITH MID-AIR TRAJECTORIES FROM A VERTICAL PLANAR SURFACE

RELATED APPLICATIONS

The present regular patent application claims the benefit of provisional application 60/047,231 filed on May 20, 1997.

BACKGROUND OF THE INVENTION

The present invention is directed to a marble track which is constructed on a two-dimensional surface, such as a refrigerator door, where the path of the marble includes open-air trajectories.

One of the most well-known of the currently available marble track construction toys is Blocks and Marbles™, manufactured by Tedco, Inc. of Hagerstown, Ind., and a similar product, called Amazing Marbles™, is manufactured by TNT, Inc. of Dallas, Tex. The components of these toys include cubes which have an internal marble channel with a right-angle turn therethrough, and rectangular blocks which have an exposed trough for the marble to roll along. The cubes are constructed to be used with one section of the channel oriented vertically, and the opening at the top of the cube is widened to facilitate capture of a falling marble. A marble track is constructed using this toy by stacking the cubes and rectangular blocks such that a marble dropped into the interior channel of a cube near the top of the track, or rolled along a trough in a rectangular block near the top of the track, will pass through a sequence of interior channels and troughs as it descends along the track.

A disadvantage of this construction toy is that cubes and rectangular blocks from the construction set are to be used to support the cubes and rectangular blocks that form the marble track, thereby limiting the length and height of the marble track. Another disadvantage of this construction toy is that the positions of the cubes and rectangular blocks are limited to points on a three-dimensional grid to provide the alignments necessary.

A wide variety of other marble track construction toys have been patented and marketed over the last hundred years. For instance, U.S. Pat. No. 5,007,876 by Daniel B. Klitsner discloses a constructable marble track consisting of track segments of a variety of geometries, including curved track segments, track segments for launching the marble into a mid-air trajectory, and track segments for catching the marble from a mid-air trajectory. Each track segment includes a cylindrical stacking element which may be removably inserted into the cylindrical stacking element of another track segment, thereby limiting the heights of the track segments to multiples of the height of the cylindrical stacking element.

U.S. Pat. No. 4,171,090 by Rolf Eisenburg discloses a marble track where the trackway consists of a pair of flexible elongated rods which are supported on a horizontal surface by support poles. The support poles are inserted into holes in a base plate which are located at positions on a two-dimensional grid. Although the heights at which the flexible elongated rods are attached to the support poles can be adjusted, this trackway does not allow mid-air trajectories of the marble.

Swedish Patent No. 47513 by Schmiederer discloses a marble track consisting of track dowels and cubic blocks having channels therethrough. The channels through the cubic blocks have widened mouths into which the ends of the track dowels are to rest. Because the track dowels are of fixed lengths, the cubic blocks must essentially be separated by the lengths of the track dowels. This marble track does not include any elements which can function to launch the marble into a mid-air trajectory.

U.S. Pat. No. 1,252,616 by Ellen W. Reif discloses a marble track consisting of chutes which are supported on a horizontal surface by pins which are inserted through bores in support rods which are mounted in base blocks. The bores are spaced at regular intervals along the support rods and the bottoms of the chutes have downward projections to prevent the chutes from sliding off the pins. Therefore, the number of orientations of the chutes, and the height of the track is limited.

It should be noted that none of these prior art toys provide a marble track toy constructed on a vertical surface. Furthermore, none of these prior art toys provide a marble track construction toy where the locations or orientations of the components are infinitely adjustable. Furthermore, none of these prior art toys provide a marble track construction toy where the track elements need not support and/or stabilize each other. Furthermore, none of these prior art toys provide a marble track construction toy where the player can design a marble tracks having high or low positioning precision requirements. Furthermore, the size of the marble tracks of the prior art toys is limited by the size and number of track components.

It is therefore a general object of the present invention to provide a construction toy, particularly a toy for construction of a track for a marble to roll down.

Furthermore, it is also an object of the present invention to provide a marble track construction toy having track elements which are removably attachable on a vertical surface.

It is also an object of the invention to provide a marble track construction toy which is not limited in height by the number or size of the components.

In addition, it is also an object of the present invention to provide a marble track construction toy having mid-air trajectories that are not limited in height by the number or size of the components.

It is another object of the present invention to provide a marble track construction toy whose size can be extended indefinitely.

It is another object of the present invention to provide a marble track construction toy where the components are not restricted to positions on a three-dimensional, two-dimensional, or even one-dimensional grid.

It is another object of the present invention to provide a marble track construction toy where the locations of the components are infinitely adjustable.

It is another object of the present invention to provide a marble track construction toy where the orientations of the components are infinitely adjustable.

It is another object of the present invention to provide a marble track construction toy where track elements need not support and/or stabilize each other, and only function to control the path of the marble, thereby substantially increasing the number of constructable track geometries and facilitating ease of assembly, dissassembly and replacement of sections of the track.

It is another object of the present invention to provide a marble track construction toy where the track can be constructed to incorporate large mid-air trajectories and therefore require high-precision positioning of the components, or the track can be constructed to incorporate smaller mid-air trajectories and therefore require lower-precision positioning of the components.

It is another object of the present invention to provide a marble track construction toy having kinetic components.

More particularly, it is an object of the present invention is to provide a toy comprised of chutes, kinetic pivoting elements, and bumpers which are removably attachable to a vertical surface.

Further objects and advantages of the present invention will become apparent from a consideration of the drawings and the ensuing detailed description. These various embodiments and their ramifications are addressed in greater detail in the Detailed Description.

BRIEF DESCRIPTION OF THE DRAWING

The accompanying drawing, which is incorporated in and forms a part of the present specification, illustrates embodiments of the invention and together with the Detailed Description serves to explain the principles of the invention.

DETAILED DESCRIPTION OF THE PREFERRED EMBODIMENTS

Figure 1:
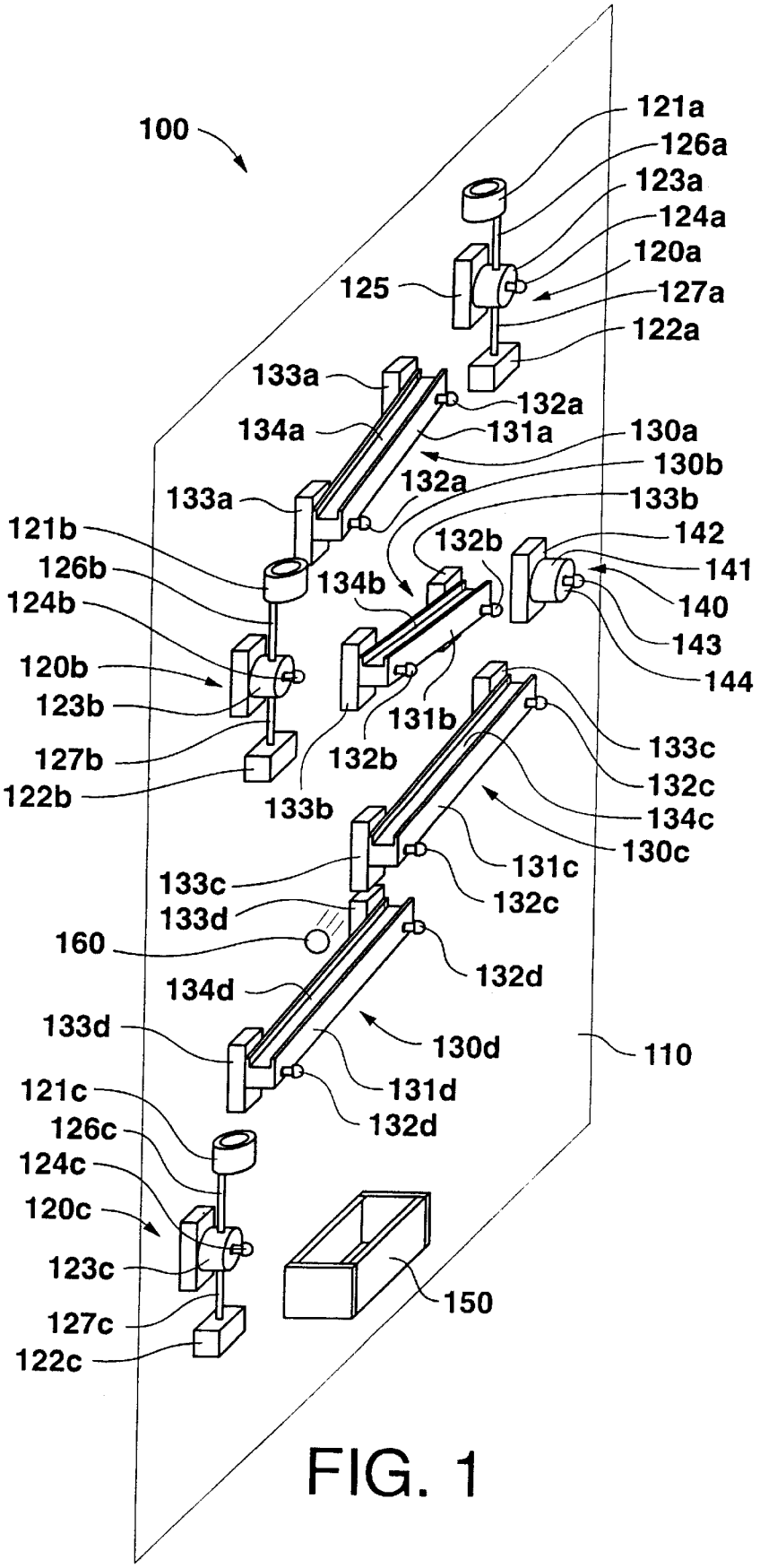
FIG. 1 is a perspective view of a marble tracks constructed from ramps, pivot elements, bumpers and a catch basket according to the present invention.

A preferred embodiment of the present invention is depicted in FIG. 1. The marble track 100 consists of left-pivot element 120*a*, right-pivot elements 120*b* and 120*c* (generically numbered by reference numeral 120), chutes 130*a*, 130*b*, 130*c* and 130*d* (generically numbered by reference numeral 130), a bumper 140, and a catch basket 150. All of these track elements 120, 130, 140 and 150 are secured to a paramagnetic refrigerator door 110 magnetically.

Each pivot element 120 has a bucket 121, counter weight 122, fulcrum 124, pivot sleeve 123, bucket arm 126, weight arm 125, and mounting ferromagnet 125. (For ease of presentation, the generic reference numeral for an element is a three-digit number, and a single letter following the three-digit reference numeral is used to indicate a particular element.) The bucket arm 126 attaches the bucket 121 to the pivot sleeve 123, and the weight arm 125 attaches the counter weight 122 to the pivot sleeve 123. The pivot sleeve 123 is rotatable about the fulcrum 124, and the fulcrum 124 is attached to the mounting magnet 125, which is magnetically removably attachable to the refrigerator door 110. The bucket 121 and the counter weight 122 have masses and are located at distances from the fulcrum 124 such that (i) in equilibrium the bucket 121 is located above, although not directly above, the counterweight 122, and (ii) when the marble 160 is placed inside the bucket 121, the bucket 121 rotates downwards to an orientation where the marble 160 will roll out of the bucket 121. (It should also be noted that if the marble 160 strikes the bucket 121 with sufficient velocity, the bucket 121 will rotate in the other direction, and if the marble 160 has enough velocity the bucket 121 will rotate far enough that the marble 160 will fall out.)

Each chute 130 has a ramp 131, a pair of mounting pegs 132, and a pair of mounting magnets 133. The ramp 131 has a longitudinal groove 134 which is slightly wider than the width of the marble 160, so that the marble 160 can roll freely down the groove 134. The mounting pegs 132 attach the ramp 131 to the magnets 133, and the magnets 133 allow the chutes 130 to be removably attached to the refrigerator door 110.

The marble track 100 of FIG. 1 also includes a bumper element 140 which consists of a cylindrical bumper 144 which is attached to a magnet 142 via a mount dowel 143. When attached on the refrigerator door 110, all portions of the cylindrical surface 141 of the bumper 144 are perpendicular to the surface of the door 110. Therefore, if the marble 160 has a velocity vector parallel to the surface of the door 110 prior to impact with the cylindrical surface 141 of the bumper 144, then the marble 160 will rebound with a velocity vector parallel to the surface of the door 110.

The final element of the marble track 100 is a catch basket 150, which is used to catch the marble 160 after it has completed its path through the marble track 100.

Because the track elements 120, 130, 140 and 150 are magnetically mounted on the refrigerator door 110, the positions of the track elements 120, 130, 140 and 150 can be adjusted across a continuum of positions, and the chutes 120 can be adjust along a continuum of orientations, to allow the path of the marble 160 to include open-air trajectories. Constructing a track with open-air trajectories generally requires trial-and-error adjustments of the positions of the track elements 120, 130, 140 and 150 to insure that the marble 160 will be properly "caught" by each track element 120, 130, 140 and 150 along the track.

For instance, when the marble 160 is put in the bucket 121 of the left-pivot element 120*a*, the bucket 121 will rotate downwards to the left. The marble 160 will fall from the bucket 121*a* when the bucket 121*a* has rotated approximately 90°, and if chute 130*a* is appropriately placed, the marble 160 will fall into the ramp 131*a* of the chute 130*a*, and roll to the end of the ramp 131*a*. However, if the marble 160 falls short of the chute 130*a*, the chute 130*a* must be moved upwards or to the right, and the track must be tested again by putting the marble 160 in the bucket of the left-pivot element 120*a*. Or, if the marble 160 hits the chute with too much force and bounces out, the chute 130*a* must be moved upwards or the angle of the chute 130*a* must be altered. This testing and repositioning of the chute 130*a* is repeated until the marble 160 falls from the bucket 121*a* of the pivot element 120*a* and rolls down the chute 130*a*.

Then, if the first right-pivot element 120*b* is appropriately placed, the marble 160 will fall from the end of the ramp 131*a* of the first chute 130*a* into the bucket 121*b* of the second pivot element 120*b*. The bucket 121*b* will then rotate downwards to the right and when the bucket has rotated approximately 90° the marble 160 will fall from the bucket 121*b*. If the second chute 130*b* is appropriately placed, the marble 160 will fall into the ramp 131*b* of the second chute 130*b*, and roll to the end of the ramp 131*b*. Then, if the bumper element 140 and the third chute 130*c* are appropriately placed, the marble 160 will fall from the ramp 131*b* of the second chute 130*b*, bounce off the cylindrical surface 141 of the bumper 144 and fall onto the ramp 131*c* of the fourth chute 130*c*.

However, if the marble 160 misses the bumper 140, then the bumper 140 must be repositioned. Or, if the marble bounces off the bumper 140, but misses the following chute 130*c*, or impacts the ramp 134*c* of the chute 130*c* but bounces out of the ramp 134*c*, the bumper 140 and/or the chute 130*c* must be repositioned. Alternatively, the track elements 120*a*, 130*a*, 120*b* and 130*b* can be repositioned to insure that the marble hits the bumper 144 with a velocity vector that will insure that the marble successfully completes the course of the marble track.

Clearly, the infinite adjustability of the positions of the chutes 130, pivot elements 120 bumpers 140 and catch basket 150 allows the player of the marble track construction set of the present invention the satisfaction of fine-tuning the positions and orientations so that the marble 160 consistently completes the track. This also allows the player to construct extremely challenging marble tracks having large mid-air trajectories and requiring precision positionings, or to construct marble tracks having smaller mid-air trajectories and requiring less precision in the positionings. And because the elements 120, 130, 140 and 150 can be positioned to receive the marble 160 at any point along a mid-air trajectory, the vertical and horizontal positioning of the components 120, 130, 140 and 150 is not restricted to locations on a one-dimensional or two-dimensional grid.

Furthermore, because these track elements are attached to the planar surface, rather than in contact with each other, the track geometries are only dependent on the characteristics, positions and inclinations of the portions of the elements in contact with the marble. In other words, while in the prior art references each track element serves the dual function of defining the path of the marble and supporting and stabilizing, or being supported and stabilized, by other track elements, each track element in the present invention only serves the purpose of controlling the path of the marble. Therefore, there is substantially increased freedom in the track geometries constructable with the system of the present invention. This also functions to make it easier to assemble, dissemble, replace or adjust portions of the track.

While the present invention is described in terms of a preferred embodiment, many other variations are possible and are to be considered within the scope of the invention. In one important species of variations, the track elements are attached by other means to other types of vertical planar surfaces. For instance, each track element may include a suction cup element so that the track elements can be attached to any smooth vertical planar surface, such as a mirror or window pane (or even a refrigerator door). Or, each track element may include a piece of removeably-attachable hook-and-loop fastener, such as hook-type Velcro® so that the track elements can be attached to any fuzzy vertical planar surface, such as the side of a couch or the back of an upholstered chair. Or, the planar mounting surface may be ferromagnetic, and the mounting elements of the construction set may be ferromagnetic or paramagnetic. Also, many other types of track elements are to be considered within the scope of the invention. The size of a track element is only limited by the size of the vertical planar surface, and the strength of the means for attaching the track element to the vertical planar surface. A track element may take the form of a trampoline, a water wheel-type mechanism, a series of steps down which the marble can bounce, a chute which has a path which varies in distance from the vertical planar surface, etc. Also, because the track elements can be mounted on the planar vertical surface with a freedom of 360° of orientation, track elements can serve multiple functions. For instance, the bottom of a chute can function as a bumper, or different portions of the cylindrical surface of a bumper can have different elastomeric properties, or two chutes can be aligned vertically at a close distance from each other to act as a vertical channel.

Other variations within the scope of the invention include: the marble track may include any number of chutes, pivot elements and bumper elements; the marble may a sphere of any material; the chute may be constructed of an elastomeric material or coated with an elastomeric material to make the impact of the marble with the chute a less elastic collision, thereby decreasing the likelihood that the marble will bounce off the track; the cross-section of the ramp of the chute element may be altered to better trap a falling marble, the particular cross-sectional design being dependent on the weight and size of the marble and the materials from which the ramp and marble are made; the chutes which run parallel to the mounting surface may have surface-mounting means of two or more lengths to position the chutes at two or more distances from the vertical mounting surface, and the construction set may also include chutes with components away from or towards the mounting surface, or may include other means for altering the distance of the marble from the mounting surface, so that portions of the path of the marble track may lie in multiple planes parallel to the mounting surface; the construction set may include a mechanical or electromechanical means for raising the marble to the top of the track once it has reached the bottom of the track; the construction set may include electrical or mechanical means for generating sounds or noises when triggered by contact with the marble; etc. Many other variations are also to be considered within the scope of the present invention. Thus, the scope of the present invention should be determined not by the examples given herein, but rather by the appended claims and their legal equivalents.

What is claimed is:

1. A construction set for construction of a marble track from a vertical planar surface, comprising:

a marble for transversing said marble track; and a plurality of track elements, each of said track elements having a means for attachment of said track element to said vertical planar surface allowing continuously-adjustable attachments at arbitrary vertical positions and arbitrary horizontal positions, and with arbitrary orientations parallel to said vertical planar surface, each of said track elements including means for altering a path of said marble impacting said track element with a momentum parallel to said vertical planar surface such that said marble also departs said means for altering with a momentum parallel to said vertical planar surface, continuous adjustment of said vertical and horizontal positions and said orientations of said plurality of said track elements allowing said marble track for said marble to include mid-air trajectories wherein said vertical planar surface and said means for attachment are magnetic materials, thereby allowing said vertical positions, said horizontal positions and said orientations of said track elements on said vertical planar surface to be adjusted by sliding said means for attachment along said vertical planar surface without detachment of said means for attachment from said vertical planar surface, whereby fine adjustments of said vertical positions, said horizontal positions and said orientations of said track elements on said vertical planar surface can be made so that said mid-air trajectories have a large span.

2. The construction set of claim 1 wherein said track elements includes a chute element, and said means for altering for said chute element is a ramp, said ramp having a base and side walls extending from said base to provide a U-shaped cross-section to constrain said marble to a rolling path on said base along a longitudinal axis of said ramp.

3. The construction set of claim 1 wherein said track elements includes a pivot element, and said means for altering for said pivot element includes a catch bucket, a counterweight, a fulcrum connected to said means for attachment, and a lever arm connecting said catch bucket and said counterweight, said catch bucket having an opening through which said marble can enter and be retained in said catch bucket, said lever arm being pivotably mounted on said fulcrum at a point on said lever arm between said catch bucket and said counterweight such that said opening of said catch bucket faces upwards when said catch bucket does not contain said marble, and, when said marble is put in said catch bucket, said lever arm rotates about said fulcrum in a plane parallel to said vertical planar surface to an orientation where said marble will roll out of said catch bucket.

4. The construction set of claim 1 wherein said track elements includes a bumper, and said means for altering for said bumper is a bumper surface perpendicular to said vertical planar surface, whereby impact of said marble with a first momentum parallel to said vertical planar surface with said bumper surface results in a rebound of said marble with a second momentum parallel to said vertical planar surface.

5. The construction set of claim 1 wherein said vertical planar surface is an environment vertical planar surface.

6. The construction set of claim 5 wherein said environmental planar surface is an indoor household environment planar surface.

7. The construction set of claim 6 wherein said environmental planar surface is an exterior surface of a refrigerator.

* * * * *